US005864893A

United States Patent [19]

Liou

[11] Patent Number: 5,864,893

[45] Date of Patent: Feb. 2, 1999

[54] WATER DISCHARGE ASSEMBLY FOR A TANK

[76] Inventor: Wen-Quey Liou, No. 10, Lane 54, Sec. 3, Rehher Rd., Taichung City, Taiwan

[21] Appl. No.: 996,636

[22] Filed: Dec. 23, 1997

[51] Int. Cl.[6] ..... E03D 1/34

[52] U.S. Cl. ..... 4/378; 4/388; 4/360

[58] Field of Search ..... 4/378, 379, 388, 4/389, 324, 325, 415, 360

[56] References Cited

U.S. PATENT DOCUMENTS

| | | | |
|---|---|---|---|
| 1,225,278 | 5/1917 | Schulte | 4/388 |
| 2,083,486 | 6/1937 | Ballou | 4/388 |
| 2,189,479 | 2/1940 | Suitt | 4/368 |
| 4,080,668 | 3/1978 | Banes | 4/325 |
| 4,138,749 | 2/1979 | Clark | 4/415 |
| 4,275,471 | 6/1981 | Becker | 4/388 |
| 4,587,679 | 5/1986 | Chen | 4/388 |
| 5,325,547 | 7/1994 | Pino | 4/378 |

*Primary Examiner*—Charles R. Eloshway
*Attorney, Agent, or Firm*—William E. Pelton

[57] ABSTRACT

A water discharge assembly includes an outlet having a neck extending from a top thereof and an overflow pipe is connected to the outlet. A control member has a top and a tubular member extending downwardly from an underside of the top, wherein the tubular member has at least one opening defined through a periphery thereof. The tubular member is movably inserted in the outlet with the underside of the top movably in contact with a top edge of the neck. A tube is fixedly disposed above the control member and has a top portion. A slot is defined in a periphery of the tube and located near the top portion and a cover is pivotally disposed to the tube so as to cover the slot. A spring and a disk are respectively received in the tube, the disk having a tiny passage defined longitudinally therethrough. A rod extends through the top portion of the tube and the spring, and the disk is fixedly mounted to the rod which is fixedly connected to the top of the control member.

4 Claims, 6 Drawing Sheets

WATER DISCHARGE ASSEMBLY FOR A TANK

BACKGROUND OF THE INVENTION

1. Field of the Invention

The present invention relates to a water discharge assembly and, more particularly, to an improved water discharge assembly for a toilet tank and which is designed to selectably discharge different amounts of water during flushes.

2. Brief Description of the Prior Art

The conventional water discharge assembly used in a toilet tank has been developed to have a function of selectably choosing a full flush or a partial flush so as to save water. Such a water discharge assembly is disclosed in U.S. Pat. No. 4,056,856, "Water Saver", issued on Nov. 8, 1977 to Reid et al. The patent disclosed a water saver having two outlets which are controlled by two respective rods and located on different levels so that a user is allowed to choose between two ways to make a flush. However, the water saver has only two choices which obviously cannot meet requirements of different situations. That is to say, the goal for saving water in a flush is not really reached because there is a minimum amount of water to be used whenever the user pushes the flush lever. It is impossible to discharge a desired amount of water which is less than the minimum amount of a flush.

The present invention intends to provide an improved water discharge assembly which discharges a desired amount of water by pulling a marked rod so that the above-mentioned problems can be mitigated and/or obviated.

SUMMARY OF THE INVENTION

The present invention provides a water discharge assembly which includes an outlet having a neck extending from a top thereof. An overflow pipe is connected beside the outlet and communicates with an interior of said outlet. A control member has a top and a tubular member extends downwardly from an underside of the top, wherein the tubular member has at least one opening defined in a periphery thereof and is movably inserted in the outlet so that the underside of the top is movably in contact with a top edge of the neck.

A tube is fixedly disposed above the control member and has a top portion and an open bottom portion through which a spring and a disk are respectively received in the tube. The tube has a slot defined in a periphery thereof near the top portion and a cover is pivotally disposed to the tube so as to cover the slot. The spring is disposed between the top portion and the disk which has an orifice defined longitudinally therethrough.

A rod extends through the top portion of the tube and the spring, the disk fixedly mounted to the rod which is fixedly connected to the top of the control member.

It is an object of the present invention to provide a water discharge assembly for a toilet tank and which is allowed to discharge a desired amount of water in a flush.

It is another object of the present invention to provide a water discharge assembly which is easily installed to a toilet tank presently used.

Other objects, advantages, and novel features of the invention will become more apparent from the following detailed description when taken in conjunction with the accompanying drawings.

DETAILED DESCRIPTION OF THE PREFERRED EMBODIMENTS

Figure 1:
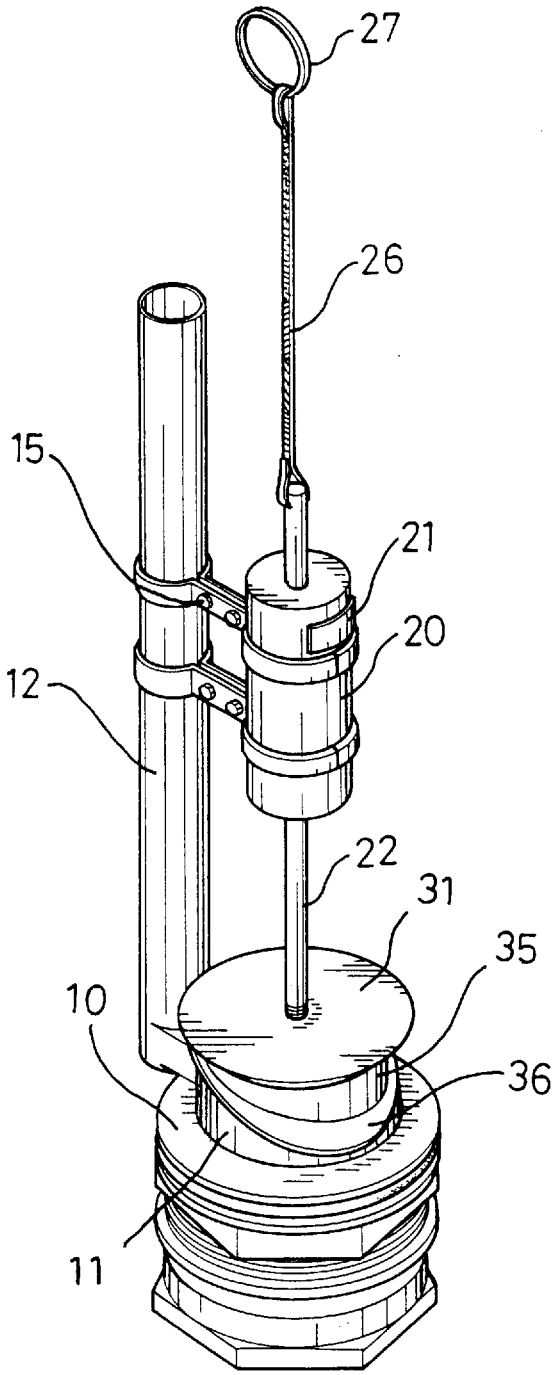
FIG. 1 is a perspective view of a water discharge assembly in accordance with the present invention.
Figure 2:
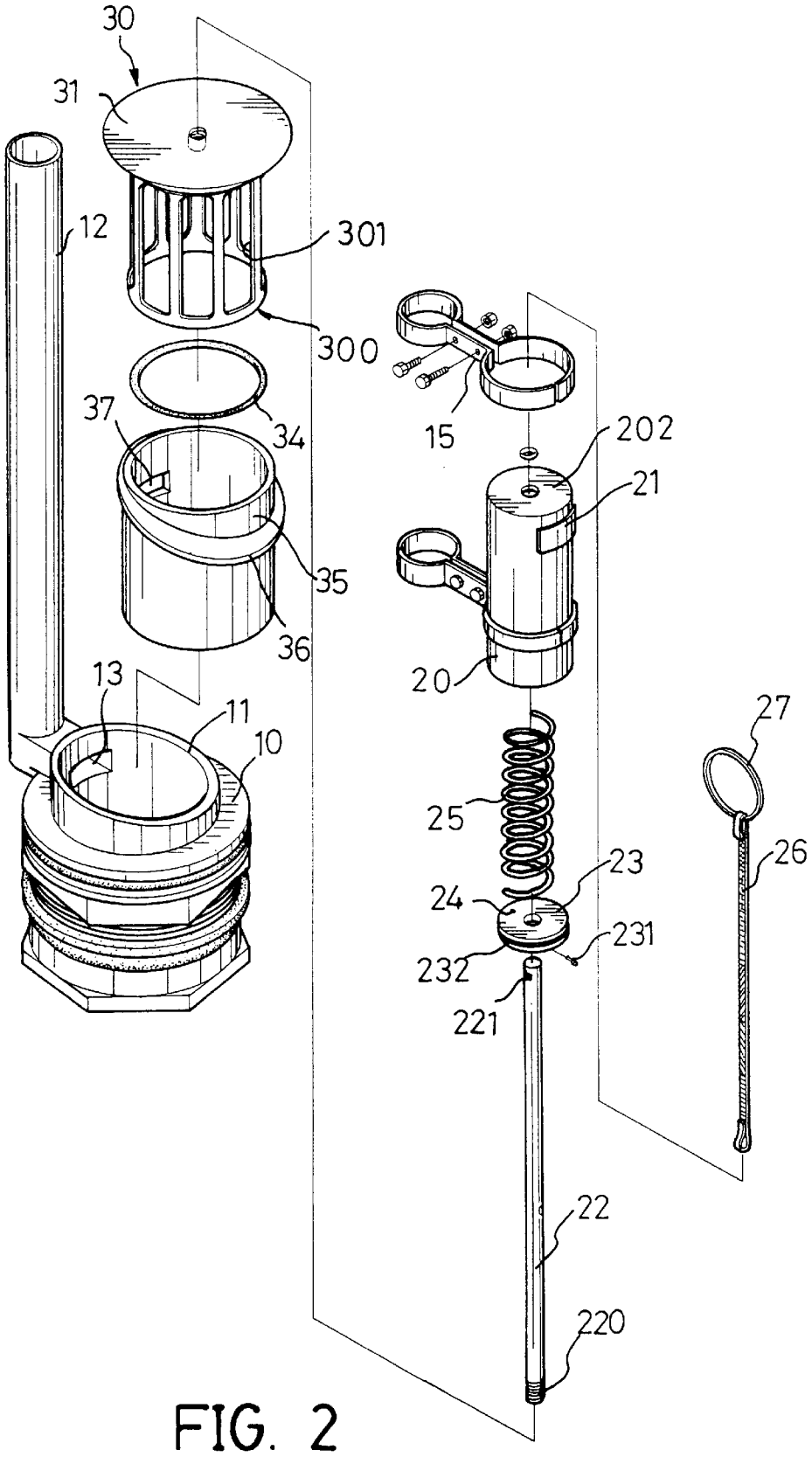
FIG. 2 is an exploded view of the water discharge assembly in accordance with the present invention.
Figure 3:
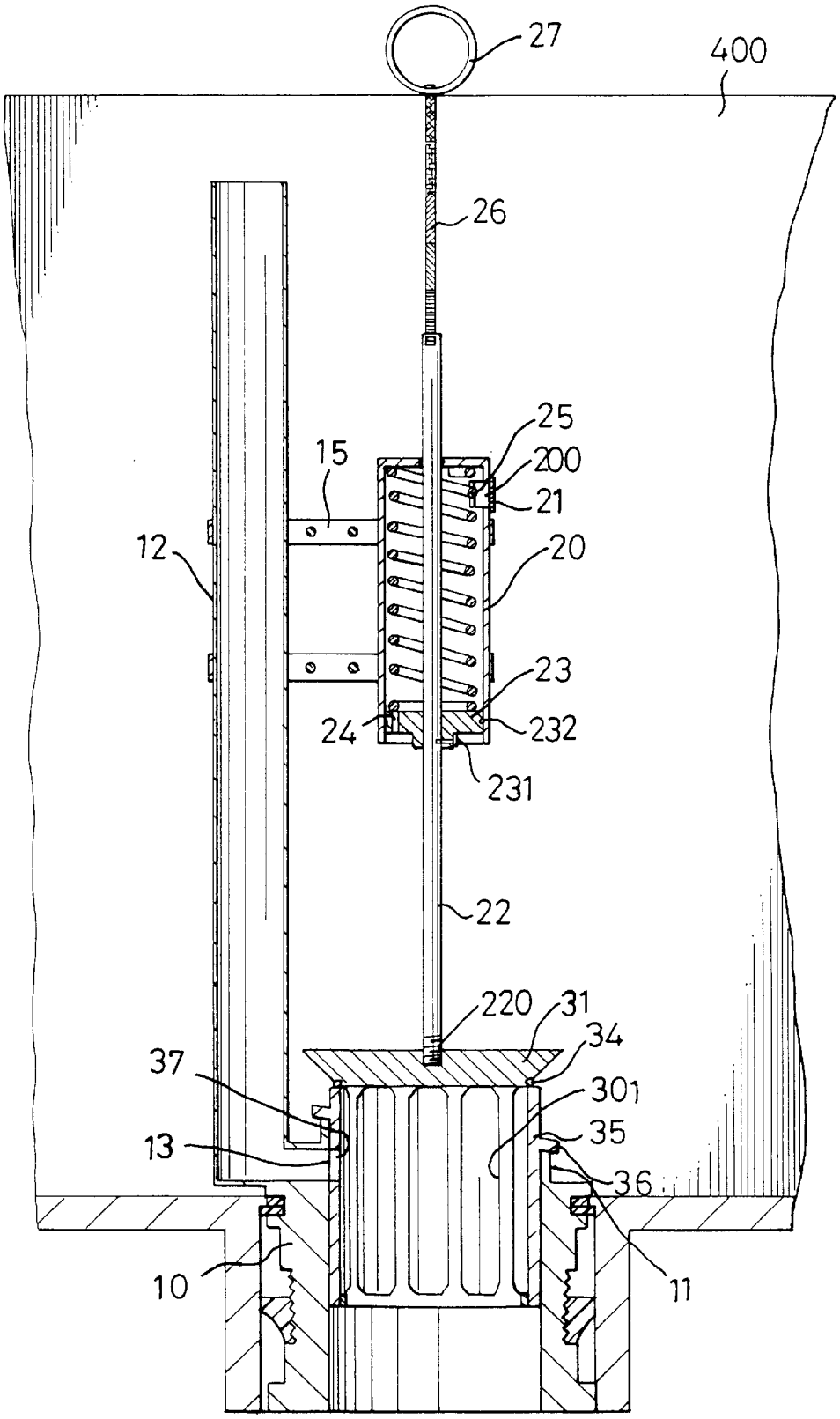
FIG. 3 is a side elevational view, partly in section, of the water discharge assembly of the present invention.

Referring to the drawings and initially to FIGS. 1 through 3, a water discharge assembly in accordance with the present invention generally includes an outlet 10 having a neck 11 extending from a top thereof. An overflow pipe 12 is connected beside the outlet 10 and communicates with an interior of said outlet 10 via a passage 13 extending therebetween. The top edge of the neck 11 of the outlet 10 is inclined corresponding to a horizontal plane.

A middle tube 35 is inserted in the outlet 10 and has a hole 37 defined in a periphery thereof so as to communicate with the passage 13. A flange 36 inclinedly extends outwardly and radially from the periphery of the middle tube 35 so as to be rested on the inclined top edge of the neck 11 of the outlet 10. Generally, the middle tube 35 is so heavy so that the middle tube 35 is stationarily rested on the outlet 10.

A control member 30 has a top 31 and a tubular member 300 extends downwardly from an underside of the top 31. The tubular member 300 has a plurality of openings 301 defined in a periphery thereof and is movably inserted in the middle tube 35 so that the underside of the top 31 is movably in contact with a top edge of the middle tube 35. The top 31 has a seal 34 received in the underside thereof so that when the top 30 is rested on the middle tube 35, there will be no leakage between the middle tube 35 and the top 31.

A tube 20 is fixedly connected to the overflow pipe 12 by two connecting members 15 and located above the control member 30. The tube 20 has a top portion 202 and an open bottom portion, and a slot 200 is defined in a periphery of the tube 20 and located near the top portion 202. A cover 21 is pivotally disposed to the tube 20 so as to cover the slot 200.

A spring 25 and a disk 23 are respectively received in the tube 20 via the open bottom portion of the tube 20. The spring 25 is disposed between the top portion 202 and the disk 23 which has an orifice 24 defined longitudinally therethrough.

A rod 22 extends through the top portion 202 of the tube 20, the spring 25, and the disk 23. The rod 22 is fixedly mounted to the disk 23 by a pin 231. The disk 23 has a seal 232 received in a periphery thereof so as to ensure a sealing feature between an inner periphery of the tube 20 and the disk 23. The rod 22 has a threaded portion 220 formed to a lower end thereof so as to fixedly engage with the top 31 of the control member 30.

A strip 26 has a lower end thereof fixedly hooked with a hole 221 defined in an upper end of the rod 22 and an upper end thereof has a ring 27 attached thereto which extends out from a toilet tank 400. The strip 26 has graduations marked thereon so as to indicate an amount of water to be discharged when the strip 26 is raised.

Figure 4:
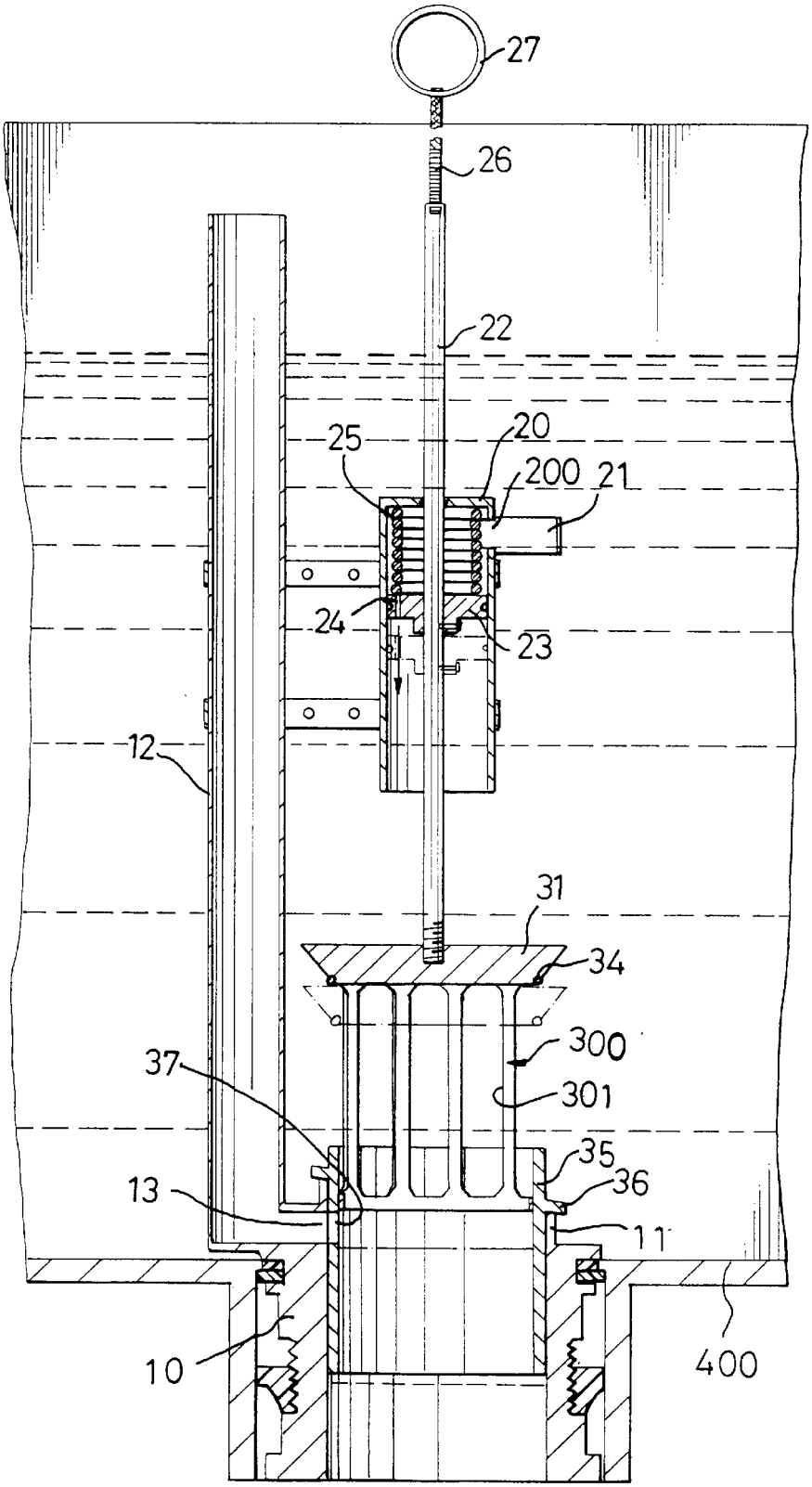
FIG. 4 is a side elevational view, partly in section, of the water discharge assembly of the present invention when a rod of the assembly is pulled upwardly.

Referring now to FIG. 4, when raising the strip 26, the disk 23 is moved together with the rod 22 to compress the spring 25, and the control member 30 is pulled upwardly also. The cover 21 is opened by outwardly rushing water in the tube 20 and water in the toilet tank 400 is discharged from the outlet 10 via the openings 301. During a flush, the disk 23 is pushed downwardly by the spring 25 and a downward movement speed of the disk 23 is decided by how soon the water in the tank 400 can occupy an interior of the tube 20 via the orifice 24 so that when the disk 23 returns to its original position, the top 31 of the control member 30 seals the middle tube 35. It is to be noted that the cover 21 covers the slot 200 by a water pressure in the toilet tank 400 as soon as the ring 27 is released. Therefore, the amount of water in a flush can be decided by raising the strip 26 and is indicated by reference to the graduations on the strip 26.

Figure 5:
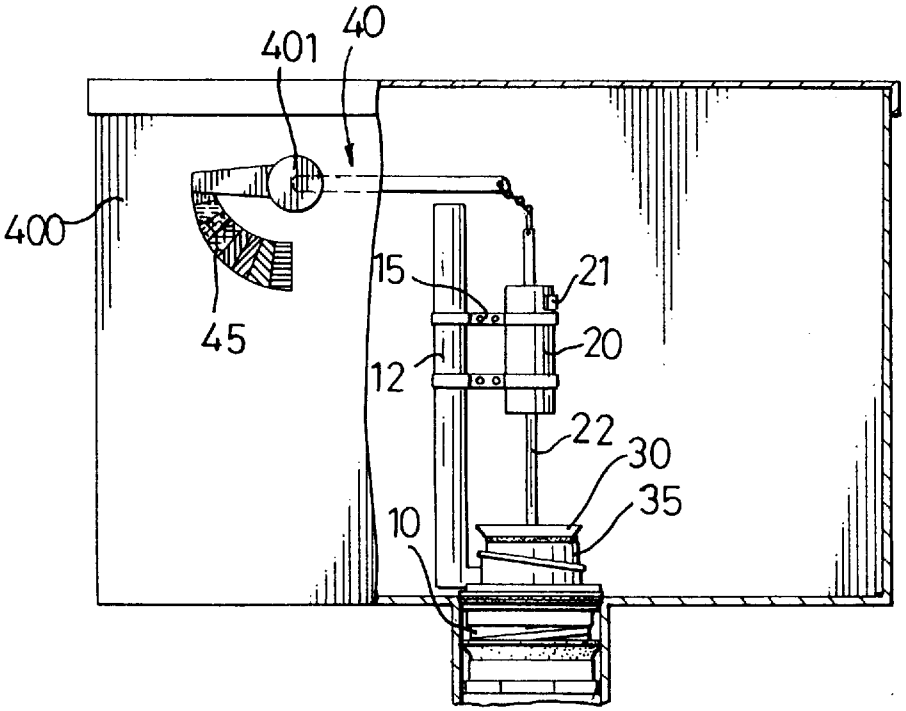
FIG. 5 is a side elevational view of another embodiment of the water discharge assembly of the present invention.

Please refer to FIG. 5 showing another embodiment of the present invention, wherein the rod 22 is connected to a conventional lever mechanism 40 and can be actuated by rotating a lever 401. A graduated label 45 is attached to an outer surface of the toilet tank 400 so as to show how much amount of water will be discharged.

Figure 6:
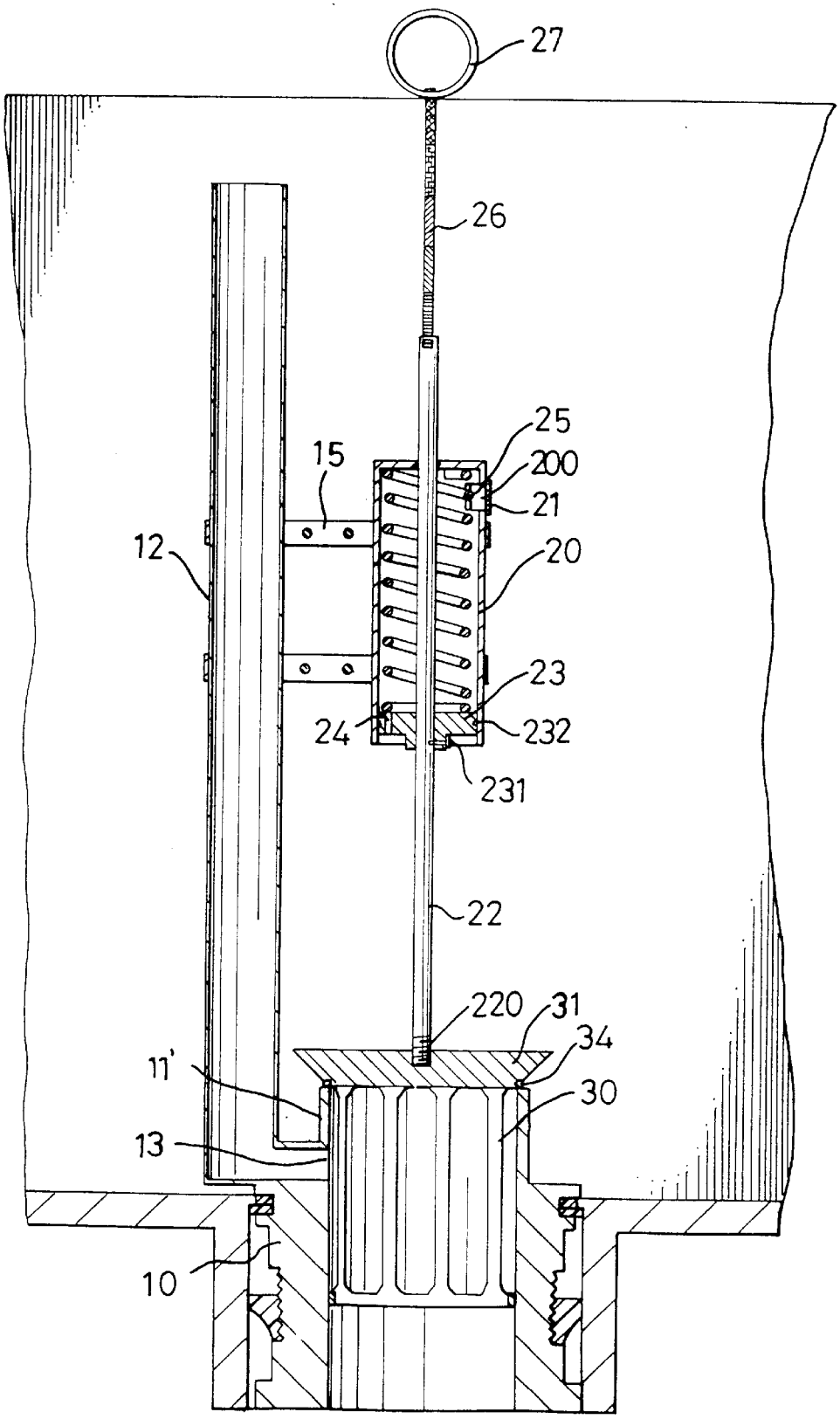
FIG. 6 is a side elevational view of yet another embodiment of the water discharge assembly of the present invention.

FIG. 6 shows yet another embodiment of the present invention, wherein the middle tube 35 is omitted and the neck 11' of the outlet 10 has a plain top edge onto which the underside of the top 31 is rested.

Although the invention has been explained in relation to its preferred embodiment, it is to be understood that many other possible modifications and variations can be made without departing from the spirit and scope of the invention as hereinafter claimed.

What is claimed is:

1. A water discharge assembly comprising:

an outlet having a neck extending from a top thereof, an overflow pipe connected to said outlet and communicating with an interior of said outlet via a passage extending therebetween;

a control member having a top and a tubular member extending downwardly from an underside of said top, said tubular member having at least one opening defined in a periphery thereof and movably inserted in said outlet so that said top sealably closes said outlet;

a tube disposed above said control member and having a closed top portion and a completely open bottom portion, said tube having a slot defined in a periphery thereof near said top portion and a cover pivotally connected to said tube so as to cover said slot and prevent water from entering said tube thereby;

a spring and a disk respectively received in said tube, said spring disposed between said top portion and said disk which has an orifice defined longitudinally therethrough, and a rod extending through said top portion of said tube and said spring, said disk fixedly mounted to said rod which is fixedly connected to said top of said control member.

2. The water discharge assembly as claimed in claim 1 wherein said top edge of said neck of said outlet is inclined with respect to a horizontal plane.

3. The water discharge assembly as claimed in claim 2 wherein a middle tube is inserted in said outlet and has a hole defined in a periphery thereof so as to communicate with said passage, said control member movably inserted into said middle tube and said underside of said top resting on a top edge of said middle tube, a flange inclinedly extending outwardly and radially from said periphery of said middle tube so as to rest on said inclined top edge of said neck of said outlet.

4. The water discharge assembly as claimed in claim 1 wherein said tube has at least one connecting member fixedly connecting said tube and said overflow pipe.

* * * * *

UNITED STATES PATENT AND TRADEMARK OFFICE

CERTIFICATE OF CORRECTION

PATENT NO. : 5,864,893
DATED : February 2, 1999
INVENTOR(S) : Wen-Guey Liou

It is certified that error appears in the above-identified patent and that said Letters Patent is hereby corrected as shown below:

On the title page,

[76] Inventor, change "Wen-Quey Liou" to --Wen-Guey Liou--.

Signed and Sealed this

Twenty-ninth Day of June, 1999

*Attest:*

Q. TODD DICKINSON

*Attesting Officer*

*Acting Commissioner of Patents and Trademarks*